US007870621B2

(12) United States Patent
Zeng

(10) Patent No.: US 7,870,621 B2
(45) Date of Patent: Jan. 18, 2011

(54) TEMPERATURE DIFFERENCE SWIMMING POOL

(76) Inventor: Yongkang Zeng, 807, 14#, Jianian Street, Fen Shui, Fangcun District, Guangzhou City, Guangdong Province (CN)

( * ) Notice: Subject to any disclaimer, the term of this patent is extended or adjusted under 35 U.S.C. 154(b) by 1218 days.

(21) Appl. No.: 10/597,268

(22) PCT Filed: Jan. 19, 2005

(86) PCT No.: PCT/CN2005/000088

§ 371 (c)(1),
(2), (4) Date: Jul. 18, 2006

(87) PCT Pub. No.: WO2005/071188

PCT Pub. Date: Aug. 4, 2005

(65) Prior Publication Data

US 2008/0086807 A1 Apr. 17, 2008

(30) Foreign Application Priority Data

Jan. 20, 2004 (CN) ..... 2004 1 0015244

(51) Int. Cl.
*E04H 4/00* (2006.01)

(52) U.S. Cl. ..... 4/505

(58) Field of Classification Search ..... 4/492, 4/493, 496, 505, 506, 490; 52/169.7
See application file for complete search history.

(56) References Cited

U.S. PATENT DOCUMENTS

| | | | | |
|---|---|---|---|---|
| 3,460,166 | A * | 8/1969 | Weber | 4/493 |
| 3,693,953 | A * | 9/1972 | Michel | 432/11 |
| 3,781,925 | A * | 1/1974 | Curtis et al. | 4/493 |
| 5,379,467 | A * | 1/1995 | Lochbaum | 4/489 |
| 7,296,308 | B2 * | 11/2007 | Turner | 4/507 |
| 2010/0095448 | A1 * | 4/2010 | Goldmann et al. | 4/505 |

* cited by examiner

*Primary Examiner*—Gregory L Huson
*Assistant Examiner*—Janie Christiansen
(74) *Attorney, Agent, or Firm*—Banger Shia

(57) ABSTRACT

A temperature difference swimming pool comprises a plurality of spaced apart water curtain controlling devices arranged at a bottom of the pool, and a temperature regulating system. Each of the water curtain controlling devices includes two juxtaposed pipes, a series of intermittent holes is formed in a top surface of the pipes, the pipes each has a closed end, and another end of the pipes is connected to a pump. Water is suctioned by the pump into one pipe and is then spurted out of the other pipe, thus making the water circulate and forming a water curtain. Since the water curtain stops the convection of the water, and the temperature regulating system is used to heat the water in one end of the swimming pool while cooling the water in the other end, thus forming a cold water region and a warm water region in one swimming pool.

5 Claims, 8 Drawing Sheets

TEMPERATURE DIFFERENCE SWIMMING POOL

BACKGROUND OF THE INVENTION

1. Field of the Invention

The present invention relates to a swimming pool, and more particularly to a temperature difference swimming pool.

2. Description of the Prior Art

Normally, the water temperature of a swing pool changes with air temperature. One therefore needs to build separately a warm water swimming pool and a cool water swimming pool as well, if both these pools are desired. Accordingly, a heating device and a cooling device will be provided respectively at the bottom of the pool for the warm water swimming pool and the cool water swimming pool. Two swimming pools take a lot more space than a single pool; in addition, the two set of water temperature regulating devices are expensive, too.

An alternative to the inconveniences of having two pools is to install a glass wall in the middle of a swimming pool; thus the swimming pool is divided into two independent swimming pools. And each swimming pool is equipped with a heating device or a cooling device. The disadvantages of this kind of swimming pool are that the two separated swimming pools are too small, and swimmer will find it difficult to adapt when switching from one pool to the other.

The present invention has arisen to mitigate and/or obviate the afore-described disadvantages.

SUMMARY OF THE INVENTION

The present invention comprises a pool filled with water, a plurality of water curtain controlling devices arranged in the pool, and a temperature regulating system employed to regulate the temperature of the water flowing the respective water curtain controlling devices, thus creating a cold water region and a warm water region in one swimming pool.

The water curtain controlling devices are spaced apart and arranged at a bottom of the pool, each of the water curtain controlling devices includes two juxtaposed pipes, a series of intermittent holes is formed in a top surface of the pipes and located along the length thereof and is parallel to the water surface of the pool, the pipes each has a closed end, and another end of the pipes is connected to a pump. Water is suctioned by the pump into one pipe via the holes thereof, and is then spurted out of the other pipe via the holes thereof, thus making the water circulates and forming a water curtain in the swimming pool.

The pipes can also be provided with an inner pipe of a smaller diameter, the inner pipes are formed in their bottom surfaces with a series of intermittent holes that are located opposite the holes of the outer pipes. The water is suctioned by the pump into one outer pipe via the holes thereof and flows out of the holes of one inner pipe, and then is pushed into the other inner pipe by the pump, and flows to the other outer pipe via the holes thereof, and is finally spurted out of the other outer pipe via the holes thereof, thus making the water circulates and forming a water curtain in the swimming pool.

Since the water curtain created by the two juxtaposed pipes at the bottom of the swimming pool stops the convection of the water in the pool, and then a temperature regulating system is used to heat the water in one end of the swimming while cooling the water in the other end of the pool, thus forming a cold water region and a warm water region in one swimming pool.

DETAILED DESCRIPTION OF THE PREFERRED EMBODIMENTS

Figure 1:
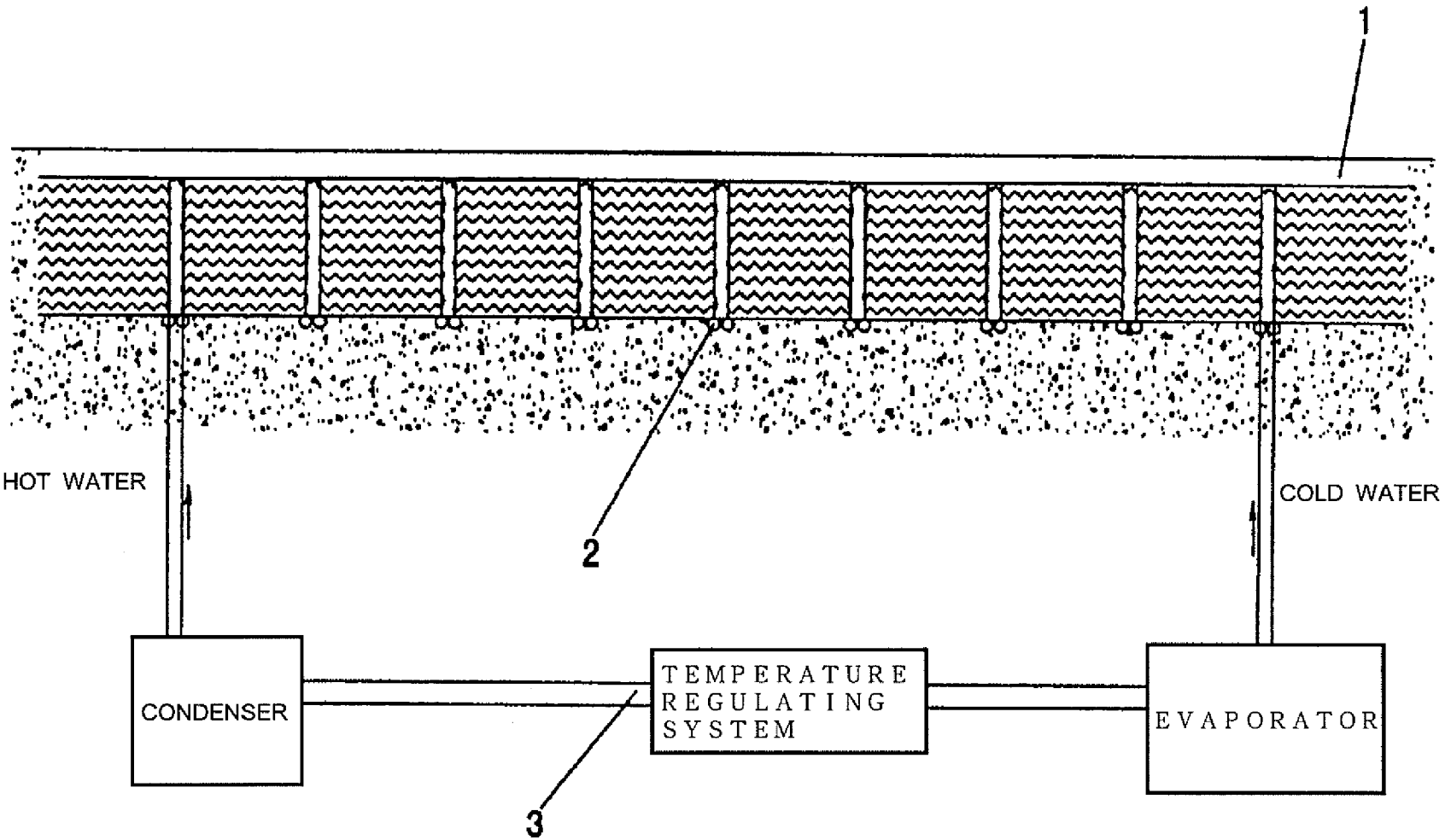
FIG. 1 is an illustrative view of a temperature difference swimming pool in accordance with the present invention.
Figure 2:
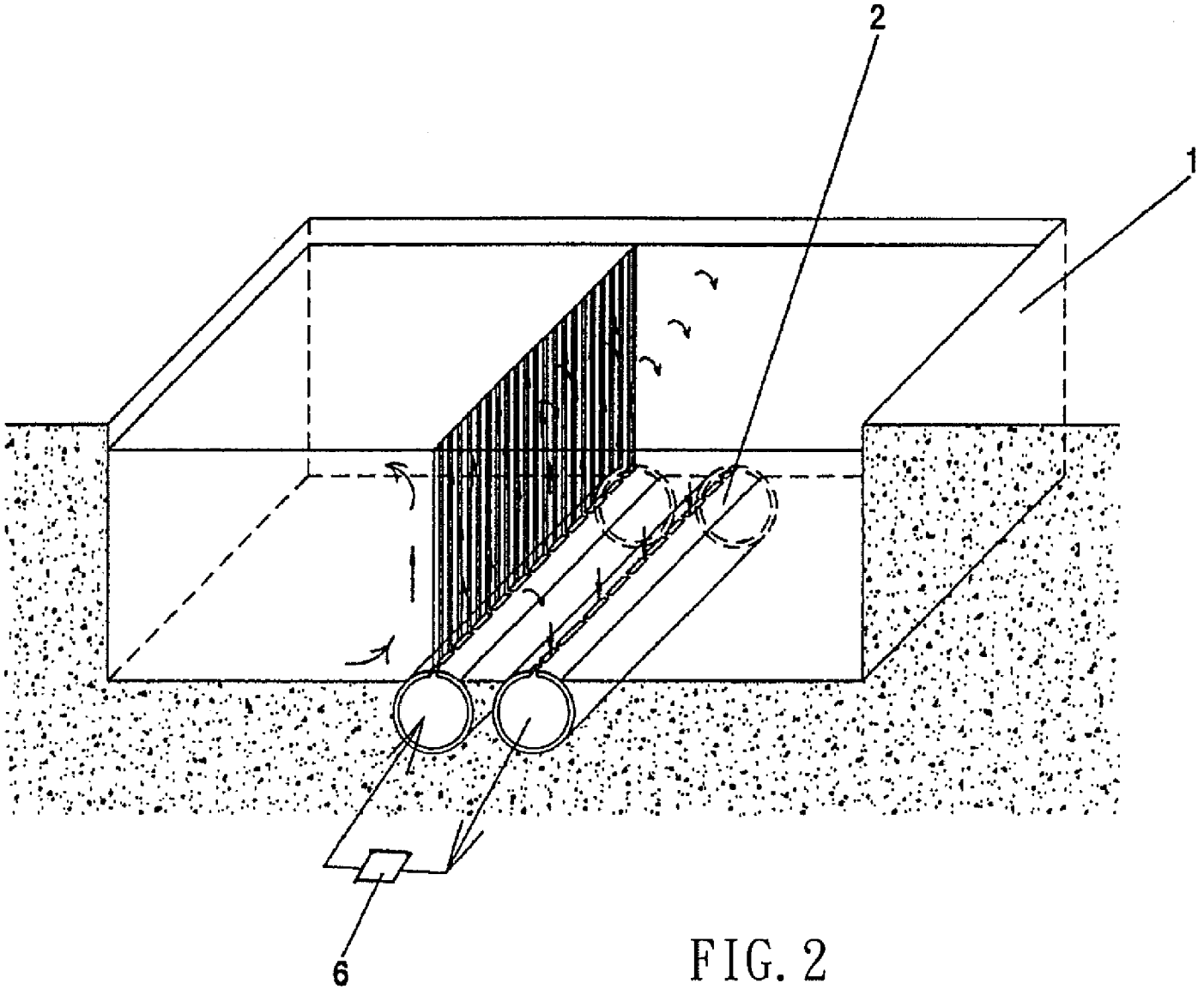
FIG. 2 is an illustrative view of a part of the temperature difference swimming pool in accordance with the present invention.
Figure 3:
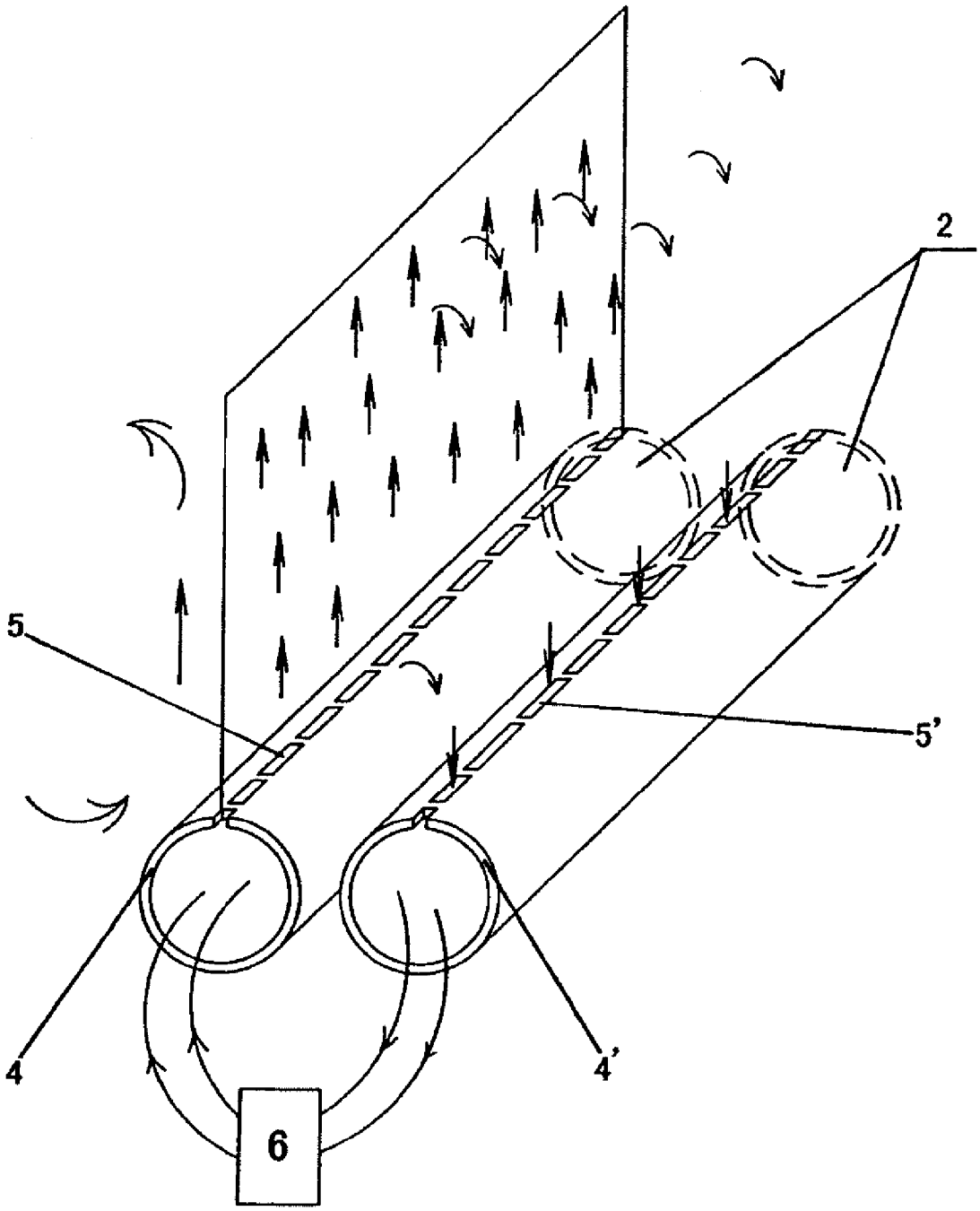
FIG. 3 is a perspective view of showing a water curtain controlling device in accordance with the present invention.
Figure 4:
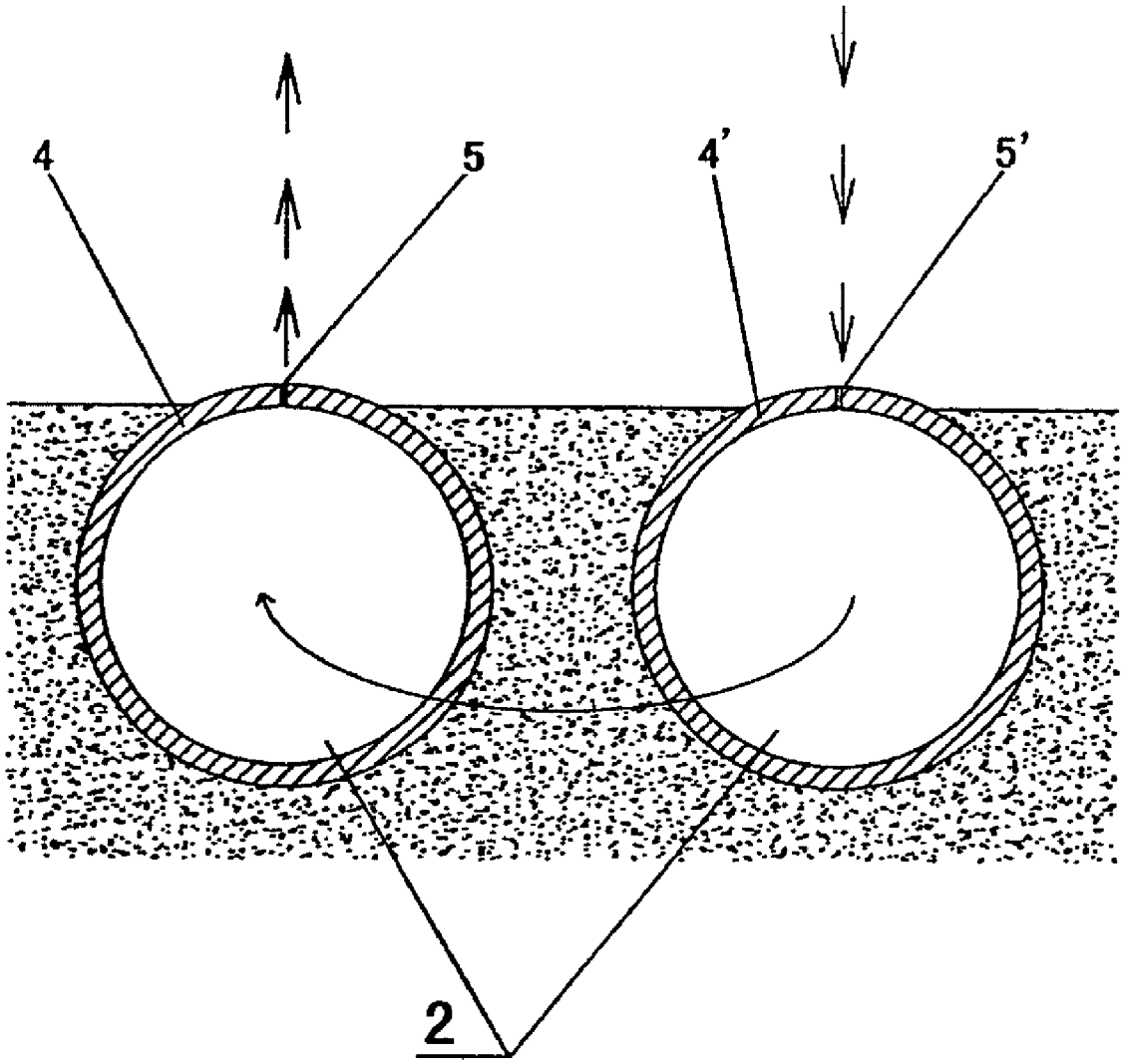
FIG. 4 is a cross sectional view of showing a water curtain controlling device in accordance with the present invention.

The present invention will be more clear from the following description when viewed together with the accompanying drawings, which show, for purpose of illustrations only, the preferred embodiment in accordance with the present invention.

Referring to FIGS. 1-4, a temperature difference swimming pool in accordance with the present invention comprises: a pool 1 filled with water, and a plurality of space-apart water curtain controlling devices 2 arranged on the bottom of the pool 1. Each of the water curtain controlling devices 2 includes two juxtaposed pipes 4 and 4'. A series of intermittent holes 5, 5' is formed in the top surface of the pipes 4 and 4' and located along the length thereof and parallel to the water surface of the swimming pool. The pipes 4 and 4' each has a closed end, and another end of the pipes 4 and 4' is connected to a pump 6.

When the pump 6 works, the water is suctioned by the pump 6 into the pipe 4' via the holes 5', and then the pump 6 pushes the water to the pipe 4. As a result, the pressure of the pipe 4 increases and the water is spurted out of the pipe 4 via the holes 5. And the water spurted out of the holes 5 will push the ambient water to move to the water surface. At the same time, water is kept being suctioned into the pump 6 via the holes 5' of the pipe 4'. In this way, affected by the two pipes 4, 4' and the pump 6, a small vortex is formed between the bottom of the swimming pool and the water surface. And after cycling, a water curtain is created from the bottom of the swimming pool to the water surface.

The water curtain controlling device 2 can prevent convention of water between two sides of the water curtain, thus stopping the heat transmission. When the pool 1 or the curtain controlling device 2 is connected to a temperature regulating system 3, the water in one region of the swimming pool is cold, in the other region of the pool the water is warm, and the water curtain controlling device 2 serves to separate the cold and warm regions.

The water curtain controlling device 2 can also change the suction and the discharge modes of the pipes 4 and 4' according to the arrangement of the pipes in the swimming pool.

The temperature difference between two sides of the water curtain controlling device 2 is 1-3° C. If a rectangular swimming pool is provided with a plurality of water curtain controlling devices, ten water curtain controlling devices can create a temperature difference of 15-25° C. The temperature regulating system can heat the water in one end of the swimming while cooling the water in the other end of the pool, and each water curtain controlling device 2 forms a temperature difference of 1-3° C. between its two sides, thus forming a cold water region and a warm water region in one swimming pool.

Figure 5:
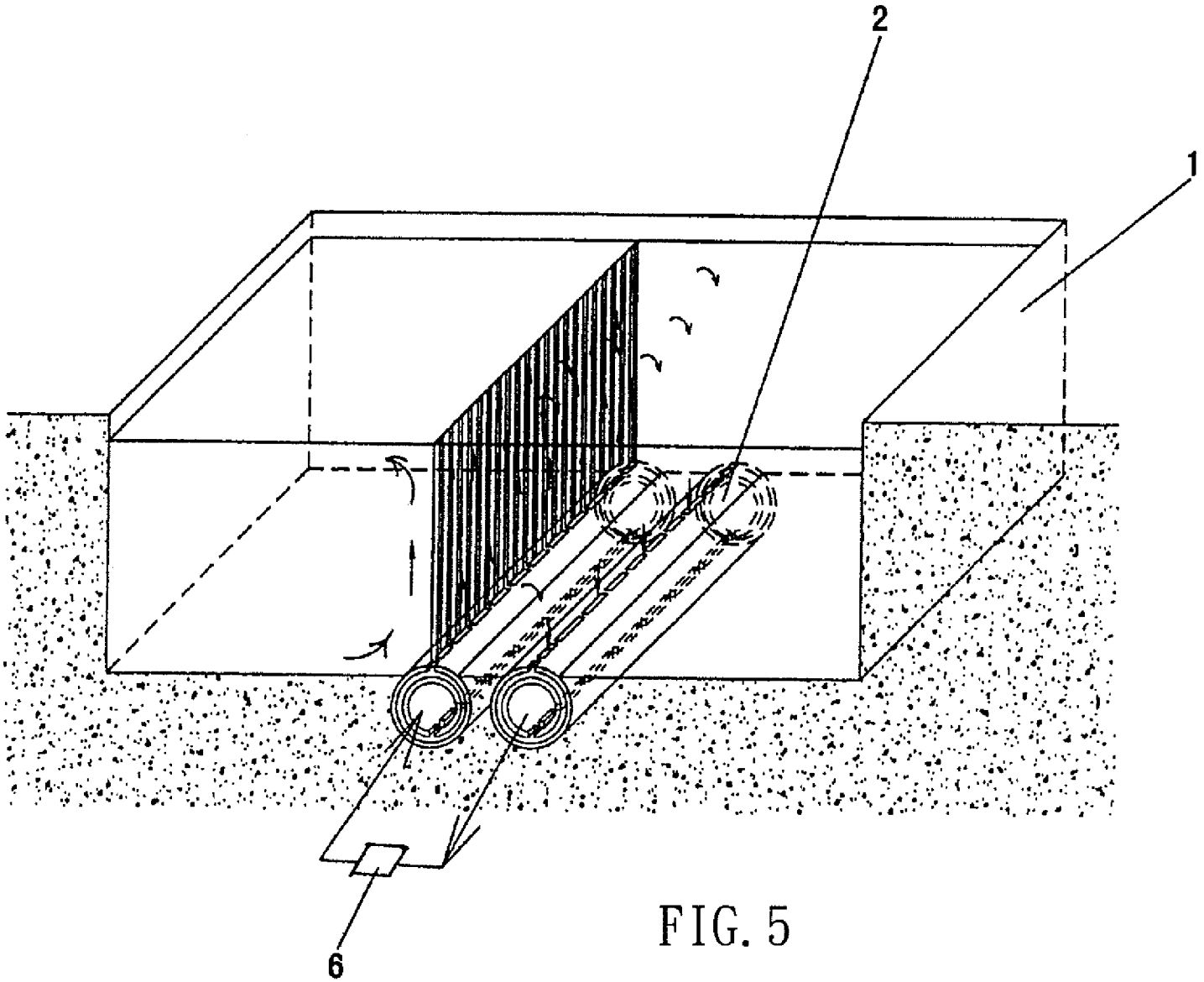
FIG. 5 is a perspective view of showing a water curtain controlling device in accordance with another embodiment of the present invention.
Figure 6:
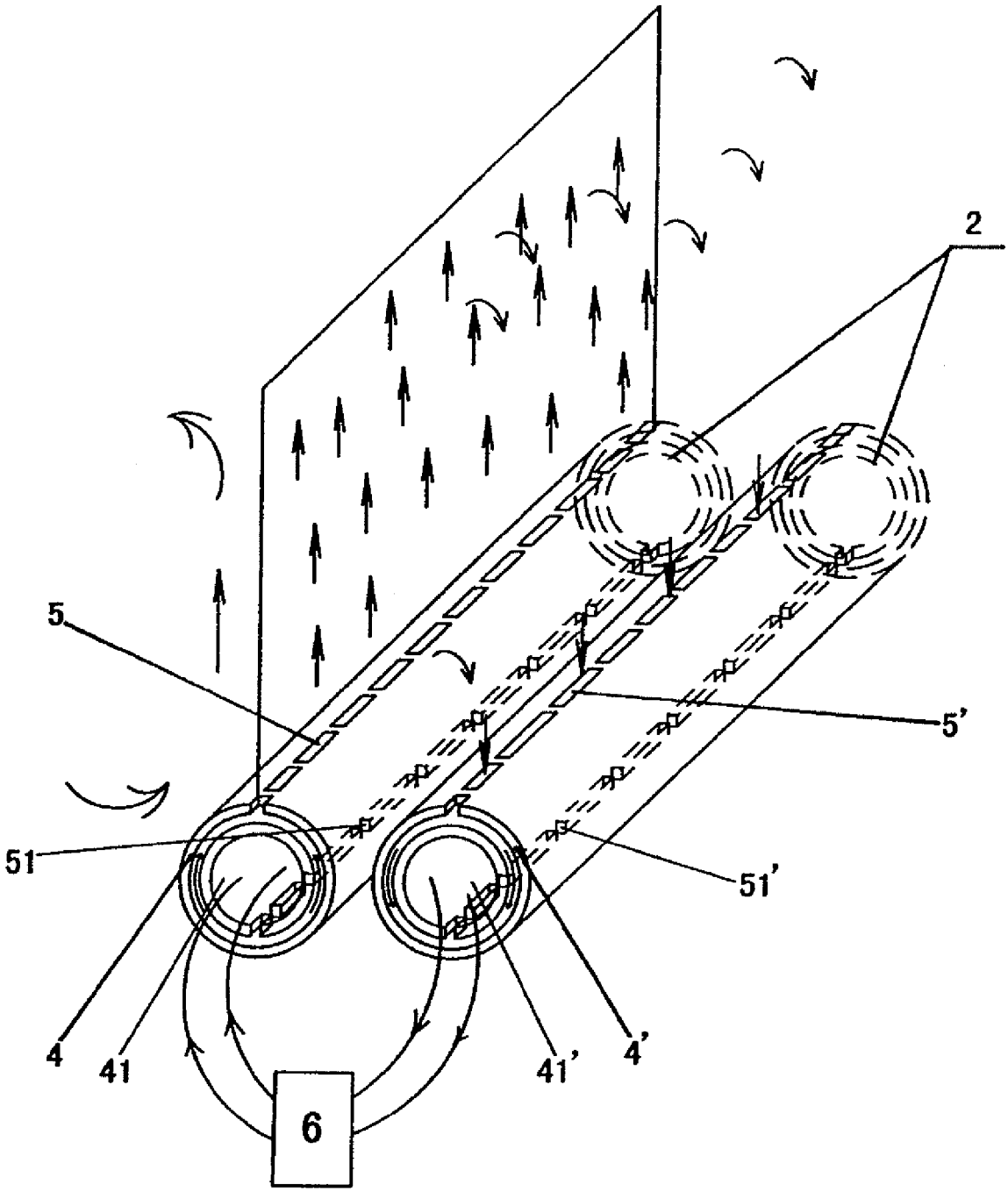
FIG. 6 is a perspective view of a part of the water curtain controlling device in FIG. 5.
Figure 7:
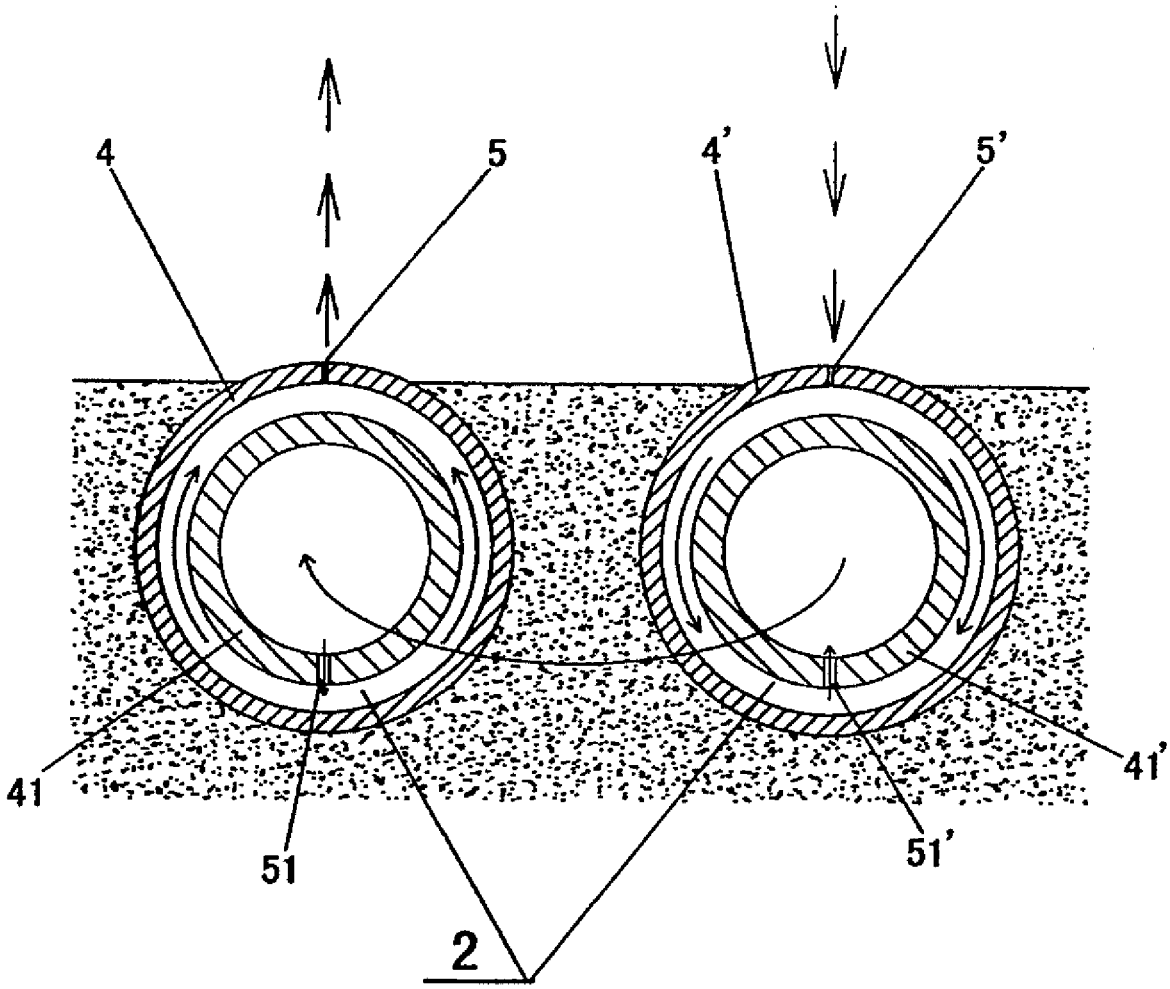
FIG. 7 is a cross sectional view of the water curtain controlling device in FIG. 5.
Figure 8:
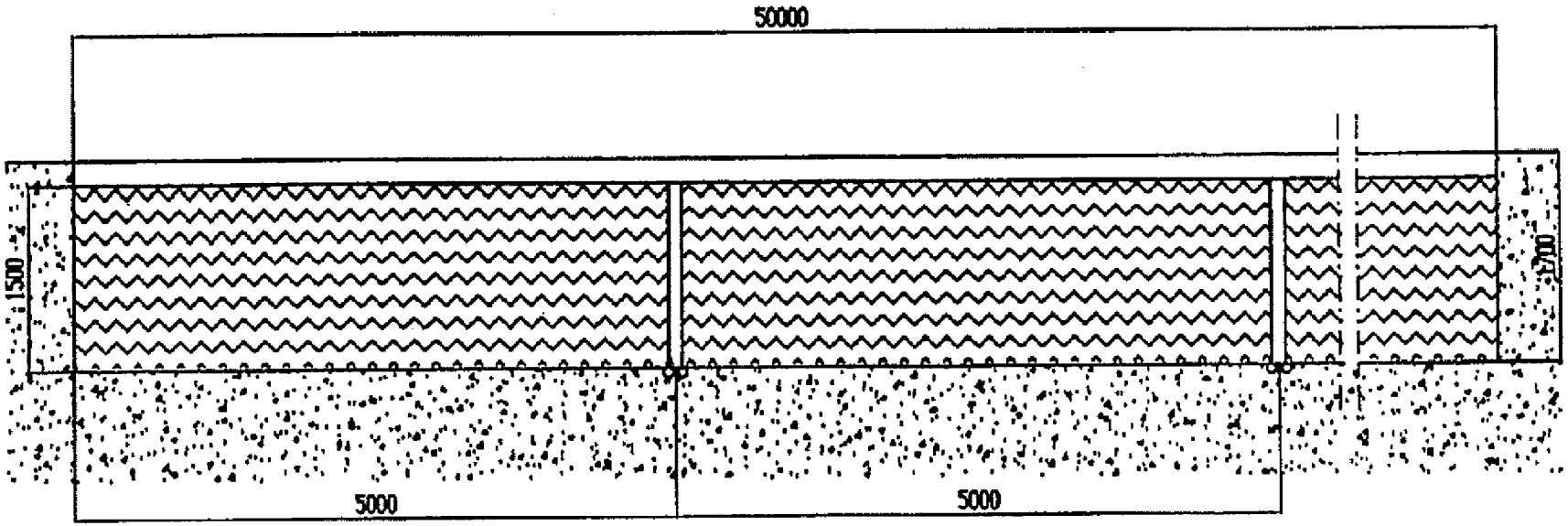
FIG. 8 is an illustrative view of a temperature difference swimming pool in accordance with another embodiment of the present invention.

Referring to FIGS. 5-7, the water curtain controlling device 2 can also take other forms. The pipes 4, 4' can be provided with an inner pipe 41, 41' with a smaller diameter. Similarly, the inner pipes 41, 41' are formed in their bottom surface (located opposite the holes 5, 5' of the outer pipes 4 and 4') with a series of intermittent holes 51, 52'.

When the pump 6 works, the water is suctioned into the pipe 4' via the holes 5' and flows out of the holes 52' of the inner pipe 41', and then is pushed into the inner pipe 41 by the pump 6, and flows to the outer pipe 4 via the holes 51, and is finally spurted out of the outer pipe 4 via the holes 5, thus making the water circulates and forming a water curtain in the swimming pool.

As shown in FIG. 5, suppose that nine water curtain controlling devices 2 are disposed at the bottom of a 30-50 meters long rectangular swimming pool and are arranged at intervals of five meters. The pipes 4 and 4' are plastic and are 80 mm in diameter and 10 meters long. One end of the respective pipes 4 and 4' is close and another end is connected to the pump. A series of intermittent holes 5, 5' of 0.5 mm diameter is formed in the top surface of the pipes 4 and 4' and located along the length thereof. The pipes 4 and 4' are then embedded in the floor of the swimming pool in such a manner that the holes 5 and 5' are exposed therefrom. Or the pipes 4, 4' are fixed at the bottom of the swimming pool. When the pump works, it will propel the water out of the pipe 4 via the holes 5, and the water will be spurted to the water surface if the propelling power is great enough. In the meantime, water is kept being suctioned into the pipe 4' via the holes 5', thus forming a water curtain. A switch valve can be additionally arranged between the pipes 4, 4' and the pump. If the intermittent holes are blocked with foreign objects, the switch valve can switch the holes 5 of the pipe 4 to suction mode, so as to suction the foreign objects away. Meanwhile, the holes 5' of the pipe 4' is switched to discharge mode, so that water is spurted out of pipe 4' via the holes 5'.

The water curtain controlling device 2 and the temperature regulating system 3 of the present invention can be installed in an open-air swimming pool (10 m×30 m or 50 m). Firstly, the water curtain controlling devices 2 are arranged along the length of the bottom of the swimming pool at intervals of 3-5 meters. The pipes are 80 mm in diameter and are juxtaposed. A series of intermittent holes of 0.5 mm width and 50 m length is formed in the top surface of the pipes 4 and 4' and located along the length thereof and parallel to the water surface of the swimming pool. The pipes each have a closed end, and another end of the pipes is connected to a pump. There are approximately nine water curtain controlling devices in the swimming pool. The water curtain controlling devices at both sides of the swimming pool cooperate the pump, the pipes, and the condenser and evaporator of the temperature regulating system to perform heat exchange, so that the water in one region of the swimming pool is cold, in the other region of the pool the water is warm. Further, the temperature regulating system can regulate the water temperature according to the weather change and create a temperature difference of 20-25° C.

The curtain controlling device and the temperature regulating system of the present invention can be installed in an indoor swimming pool. Since the temperature difference of the water in an indoor swimming poor is very small, the resultant energy consumption is comparatively low. Firstly, choose an indoor swimming pool where the indoor is about 28° C. The swimming pool is 10 m×30 m in size, and water depth is 1.5 m. And then, 9 water curtain controlling devices are arranged along the length of the bottom of the swimming pool at intervals of 3 meters. Finally, temperature regulating system and electric control equipment are installed in the swimming pool, so as to control the water temperature of the swimming pool within 17-40° C. Since the water temperature difference of this swimming pool is very great, it can promote heart and vein health when people swim in such a cold and warm water swimming pool, and this is particularly good to those middle-aged and old aged people.

The pipes 4 and 4' can be PVC pipe or anticorrosive metal pipe.

While we have shown and described various embodiments in accordance with the present invention, it is clear to those skilled in the art that further embodiments may be made without departing from the scope of the present invention.

What is claimed is:

1. A temperature difference swimming pool comprising a pool filled with water; characterized in that: a plurality of water curtain controlling devices is arranged in the pool, and a temperature regulating system is employed to regulate the temperature of the water flowing through the respective water curtain controlling devices;

the water curtain controlling devices are spaced apart and arranged at a bottom of the pool, each of the water curtain controlling devices includes two juxtaposed pipes, a series of intermittent holes is formed in a top surface of each of the pipes, the pipes each has a closed end, and another end of the pipes is connected to a pump;

the pipes each are provided with an inner pipe of a smaller diameter, the inner pipes are formed in their bottom surface with a series of intermittent holes that are located opposite the holes of the outer pipes.

2. The temperature difference swimming pool as claimed in claim 1, wherein water is suctioned by the pump into a first one of the two pipes via the intermittent holes of the first pipe, and is then spurted out of a second one of the two pipes via the intermittent holes of the second pipe, thus creating water circulation.

3. The temperature difference swimming pool as claimed in claim 1, wherein the pipes are plastic or metal.

4. The temperature difference swimming pool as claimed in claim 1, wherein the water curtain controlling devices are embedded in or fixed at the bottom of the swimming pool.

5. The temperature difference swimming pool as claimed in claim 1, wherein water is suctioned by the pump into a first one of the two pipes via the intermittent holes of the first pipe and flows out of the intermittent holes of the inner pipe of the first pipe, and then is pushed into the inner pipe of a second one of the two pipes by the pump, and flows to the outer pipe via the intermittent holes of the inner piper of the second pipe, and is finally spurted out of the second outer pipe via the intermittent holes of the second pipe, thus making the water circulates.

* * * * *